US006255932B1

(12) United States Patent
Kubodera et al.

(10) Patent No.: US 6,255,932 B1
(45) **Date of Patent: *Jul. 3, 2001**

(54) ELECTRONIC COMPONENT HAVING BUILT-IN INDUCTOR

(75) Inventors: Noriyuki Kubodera; Yoshiaki Kohno, both of Nagaokakyo (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/410,052

(22) Filed: Mar. 24, 1995

(30) Foreign Application Priority Data

Mar. 31, 1994 (JP) ..... 6-063144

(51) Int. Cl.[7] ..... H01F 5/00
(52) U.S. Cl. ..... 336/200; 336/83; 336/232
(58) Field of Search ..... 336/83, 200, 232

(56) References Cited

U.S. PATENT DOCUMENTS 3,731,005 * 5/1973 Shearman ..... 336/200
4,117,588 * 10/1978 Johnson ..... 336/200
4,959,631 * 9/1990 Hasagawa et al. ..... 336/232
5,349,743 * 9/1994 Grader et al. ..... 336/200

FOREIGN PATENT DOCUMENTS

2163603 * 2/1986 (GB) ..... 336/200
44-14264 * 8/1965 (JP) ..... 336/83
62-104112 * 5/1987 (JP) ..... 336/200
6-151185 * 5/1994 (JP) ..... 336/200

OTHER PUBLICATIONS

IBM Technical Disclosure Bulletin, "Etched Transvormer", Crawford et al, vol. 8. No. 5, Oct. 5, 1965 p. 723, copy in 336–200.*

* cited by examiner

*Primary Examiner*—Anh Mai
(74) *Attorney, Agent, or Firm*—Ostrolenk, Faber, Gerb & Soffen, LLP

(57) ABSTRACT

A ceramic multilayer substrate (13) having a built-in inductance includes a conductor (15) which is arranged in a substrate consisting of a sintered body (14), and ferromagnetic metal films (6A, 6B) consisting of Ni which are arranged on both sides of the conductor (15).

20 Claims, 5 Drawing Sheets

ELECTRONIC COMPONENT HAVING BUILT-IN INDUCTOR

BACKGROUND OF THE INVENTION

1. Field of the Invention

The present invention relates to an electronic component having a built-in inductor which comprises a substrate and an inductance element provided therein, and more particularly, it relates to an electronic component having a built-in inductor which comprises an inductance element of a ferromagnetic metal.

2. Description of the Background Art Conventional electronic components comprising substrates and inductance elements provided therein are manufactured by the following methods (1) to (3):

(1) A method of providing an inductance element, which is prepared by forming a conductor in a ferrite member with conductor paste, in an unfired ceramic substrate and thereafter simultaneously firing the substrate material and the conductor paste, thereby obtaining a substrate having a built-in inductance.

(2) A method of providing a ferrite layer, which is previously formed with a conductor consisting of conductor paste therein, in an unfired ceramic substrate and firing the unfired ceramic substrate with the ferrite layer and the conductor paste.

(3) A method of utilizing an inductance which is generated from a conductor provided in a substrate, without particularly employing a ferromagnetic substance.

Each of the methods (1) and (2) comprises the step of simultaneously firing the ceramic material forming the substrate and the ferrite material. Therefore, the ferrite and ceramic components are mutually diffused in the firing, to disadvantageously reduce electric characteristics. In particular, iron oxide which is contained in the ferrite material is quickly diffused to reduce insulation resistance upon diffusion in an insulating ceramics. Thus, it is necessary to suppress the reduction of insulation resistance caused by such diffusion of the iron oxide.

In the method (3) utilizing an inductance which is generated from a conductor provided in a substrate without employing a ferromagnetic substance, on the other hand, it is necessary to increase the length of the conductor part for forming the inductance, and hence the component size is inevitably increased.

SUMMARY OF THE INVENTION

An object of the present invention is to provide an electronic component having a built-in inductor hardly causing reduction of electric characteristics such as insulation resistance, which can reduce the size of a portion forming an inductance element.

The present invention is directed to an electronic component having a built-in inductor comprising a substrate which consists of an insulating material, a conductor which is provided in the substrate, and at least one ferromagnetic metal film which is arranged in the substrate to be separated from but in proximity to the conductor.

In the electronic component having a built-in inductor according to the present invention, at least one ferromagnetic metal film is arranged in proximity to the conductor as described above, thereby forming an inductor. In this case, the ferromagnetic metal film may be arranged in the substrate to be flush with the conductor, or at least one ferromagnetic metal film may be formed in proximity to the conductor in a position opposite to the conductor surface through an insulating material layer forming the substrate. These two modes of arrangement may be combined with each other.

The inductor is formed by arranging the ferromagnetic metal film, which can be prepared from a proper ferromagnetic metal material. When the substrate is made of a ceramics material, the ferromagnetic metal film is preferably prepared from a material capable of withstanding firing of the ceramics material, such as a ferromagnetic metal film which is made of or mainly composed of Ni, for example.

While the feature of the electronic component having a built-in inductor according to the present invention resides in that the conductor and at least one ferromagnetic metal film are arranged in the substrate as described above, the substrate is not restricted to that made of ceramics, but may be made of another insulating material such as synthetic resin.

According to the present invention, at least one ferromagnetic metal film is arranged in the substrate in proximity to the conductor, to form the inductor. Namely, the inductance element is formed by arranging the ferromagnetic metal film in proximity to the conductor, whereby no ferrite member is required as a magnetic material. Therefore, the electronic component having a built-in inductor can be formed by a single substrate material, and hence no problem such as reduction of insulation resistance is caused by mutual diffusion of ceramics and ferrite when the substrate is made of ceramics, for example. Thus, it is possible to provide an electronic component having a built-in inductor which has excellent electric characteristics and reliability.

When the length of the conductor provided in the substrate of the conventional electronic component is increased for forming an induction element, the size of the inductance forming part is disadvantageously increased. According to the present invention, on the other hand, the inductor is formed by arranging the aforementioned ferromagnetic metal film, whereby it is possible to miniaturize the electronic component having a built-in inductor with no dimensional increase of the inductance element forming part.

When the ferromagnetic metal film is formed by a thin film forming method and patterned by photolithography, further, the ferromagnetic metal film can be formed in high accuracy, whereby an inductance can be accurately implemented at the designed value.

While the method of arranging the ferromagnetic metal film can be varied as described above, it is possible to implement a higher inductance when the ferromagnetic metal film is arranged in the substrate not only to be flush with the conductor but in proximity to the conductor in a position opposed to the conductor surface.

When the ferromagnetic metal film is formed by a metal film which is made of or mainly composed of Ni, further, the ferromagnetic metal film is hardly oxidized in firing even if the substrate is made of ceramics.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

EXAMPLE 1

Figure 1:
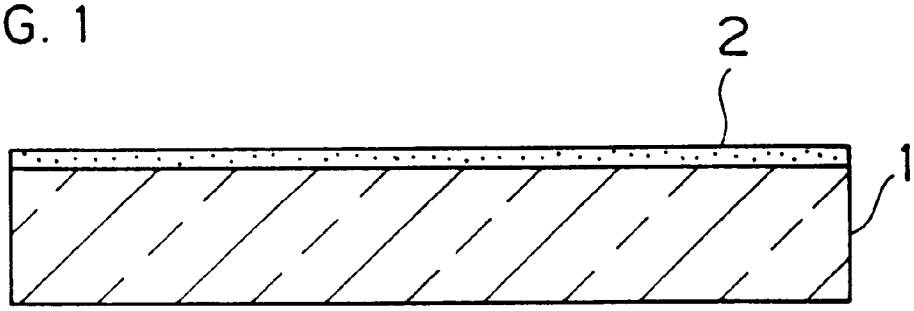
FIG. 1 is a sectional view showing a glass substrate provided with a mold lubricant layer.

First prepared was a glass substrate 1 provided with a mold lubricant layer 2 on its surface. The mold lubricant layer 2 can be formed by coating the glass substrate 1 with fluororesin (FIG. 1).

Figure 2:
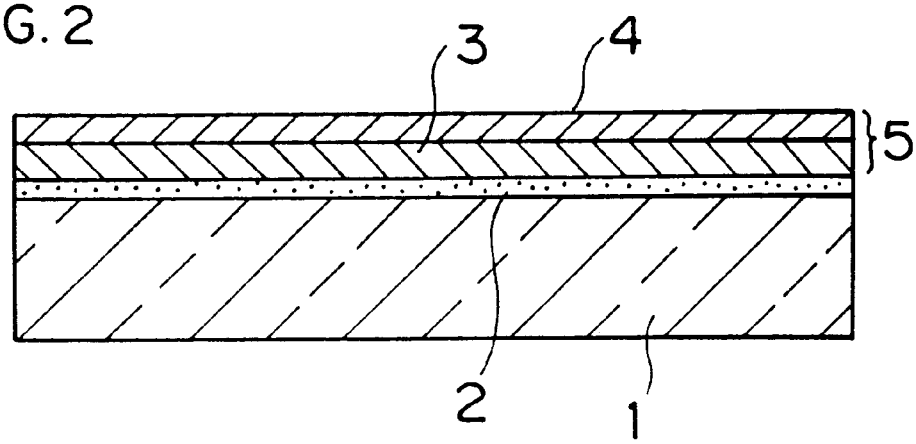
FIG. 2 is a sectional view showing Ag and Pd films deposited on a glass substrate.

Then, Ag and Pd films 3 and 4 having thicknesses of 0.7 μm and 0.1 μm respectively were deposited on the overall major surface of the glass substrate 1 which was provided with the mold lubricant layer 2, as shown in FIG. 2. Such a two-layer deposition film 5 was patterned by photolithography, to form a metal thin film 5A (this plane shape is referred to as a pattern A) for forming a conductor shown in FIG. 3. The metal thin film 5A extends perpendicularly to the plane of this figure, with a width of 500 μm.

Figure 4:
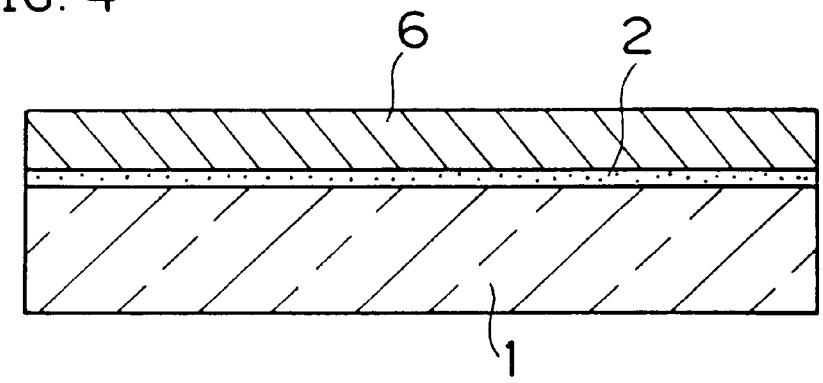
FIG. 4 is a sectional view showing a ferromagnetic metal film deposited on a glass substrate.

Similarly to the above, an Ni film 6 having a thickness of 1.0 μm was deposited on another glass substrate 1 provided with a mold lubricant layer 2 on its surface (FIG. 4).

Figure 5:
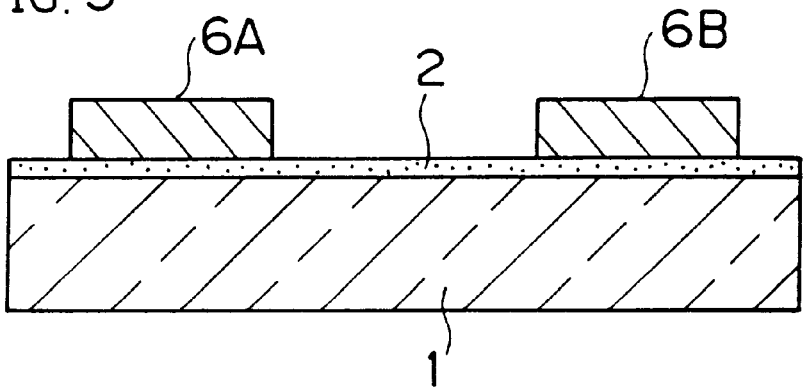
FIG. 5 is a sectional view showing a patterned state (pattern B) of the ferromagnetic metal film appearing in FIG. 4.

Then, the Ni film 6 was patterned by photolithography as shown in FIG. 5, to form ferromagnetic metal films 6A and 6B (this plane shape is referred to as a pattern B). The ferromagnetic metal thin films 6A and 6B extend perpendicularly to the plane of this figure, with widths of 500 μm respectively.

Figure 6:
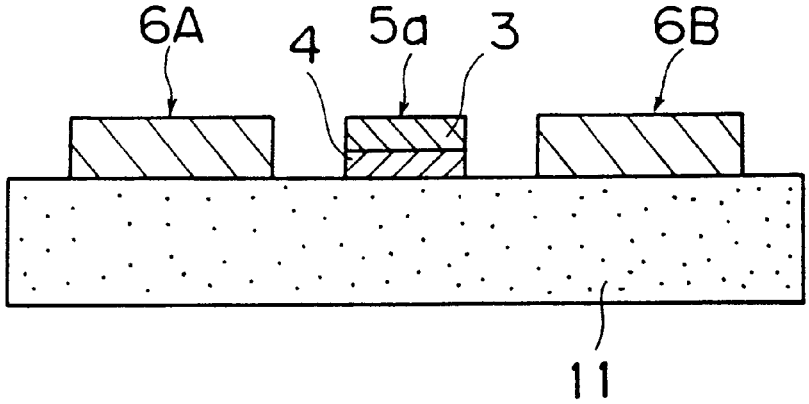
FIG. 6 is a sectional view showing the patterns A and B transferred onto an alumina green sheet.
Figure 7:
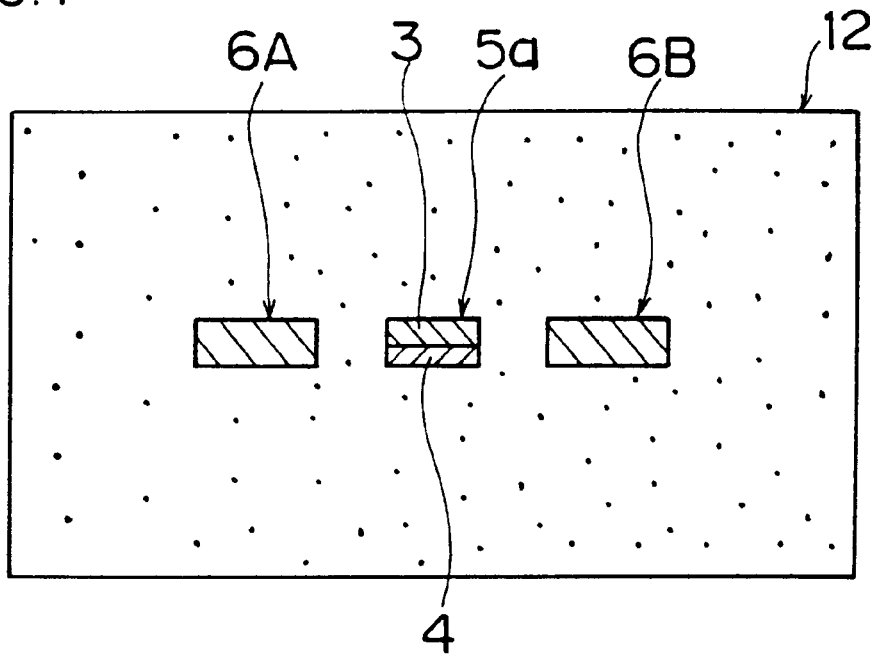
FIG. 7 is a sectional view showing a ceramic laminate obtained in Example 1.

Then, an alumina green sheet 11 having a thickness of 200 μm was prepared as shown in FIG. 6. The metal thin film 5*a* and the ferromagnetic metal films 6A and 6B shown in FIGS. 3 and 5 were transferred onto the alumina green sheet Then, blank alumina green sheets having thicknesses of 200 μm were stacked on upper and lower portions of the alumina green sheet 11 and pressurized along the thickness direction, thereby obtaining a ceramic laminate 12 shown in FIG. 7. The metal thin film 5*a* is embedded in the ceramic laminate 12, while the ferromagnetic metal films 6A and 6B are arranged on both sides of the metal thin film 5*a* to be separated from the same.

Figure 8:
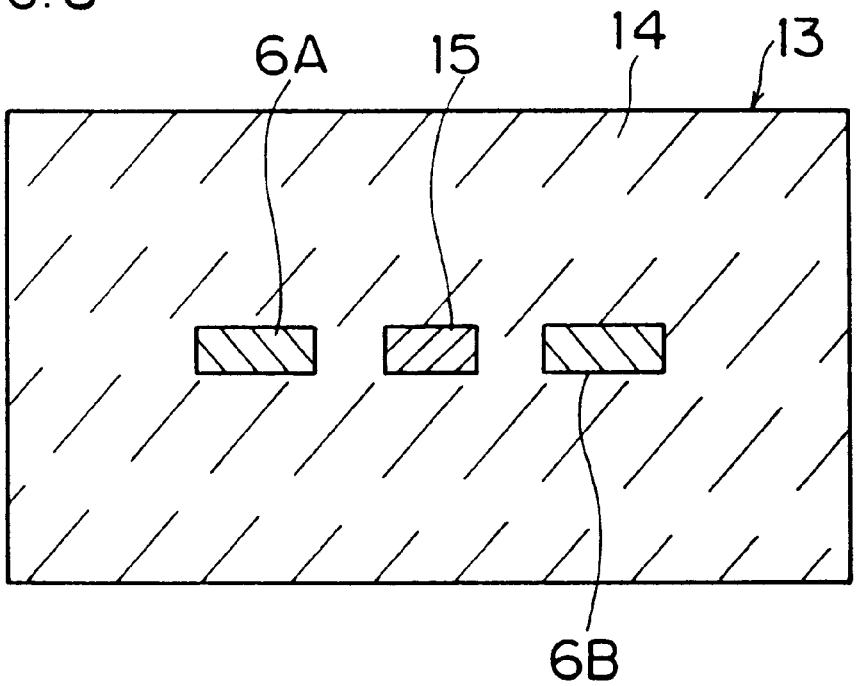
FIG. 8 is a sectional view showing a ceramic multilayer substrate according to Example 1.

Then, the ceramic laminate 12 was fired under a reducing atmosphere, to obtain a ceramic multilayer substrate 13 shown in FIG. 8. In this ceramic multilayer substrate 13, a ceramic sintered body 14 is formed by firing of the ceramic material, while a conductor 15 is formed by the metal thin film 5*a* which was alloyed in the firing. The ferromagnetic metal films 6A and 6B are arranged on both sides of the conductor 15. Therefore, an inductance element is formed by the conductor 15 and the ferromagnetic metal films 6A and 6B.

EXAMPLE 2

Figure 9:
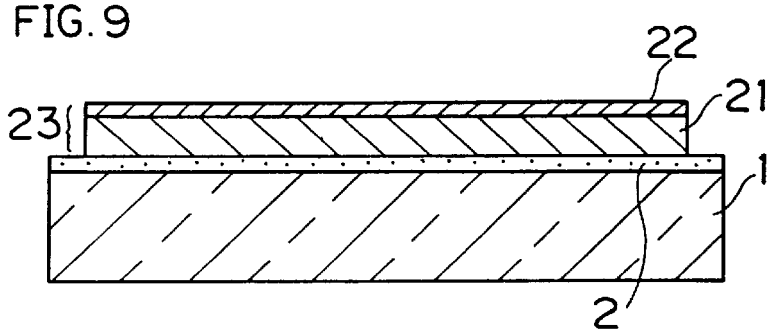
FIG. 9 is a sectional view for illustrating a ferromagnetic metal film (pattern C) prepared in Example 2.

Similarly to Example 1, Ni and Mo films 21 and 22 having thicknesses of 0.9 μm and 0.1 μm were successively deposited on a major surface of a glass substrate 1 which was provided with a mold lubricant layer 2. Thereafter patterning was performed by photolithography similarly to Example 1, to form a multilayer metal film 23 having a width of 1.0 mm as shown in FIG. 9 (this plane shape is referred to as a pattern C). This multilayer metal film 23 was formed by the aforementioned Ni and Mo films 21 and 22 serving as lower and upper layers respectively.

Figure 3:
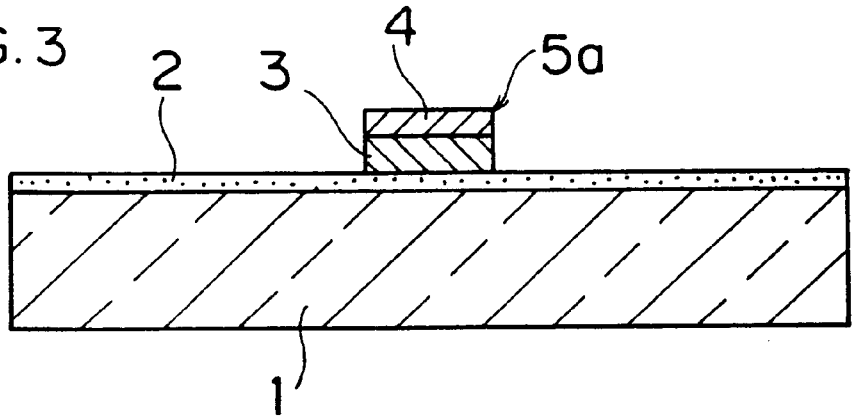
FIG. 3 is a sectional view showing a patterned state (pattern A) of the deposition films appearing in FIG. 2.

On the other hand, a metal thin film transfer material having a metal thin film 5*a* (pattern A) provided with a Cu film 3 (with no upper layer 4) which was similar to that shown in FIG. 3 was prepared similarly to Example 1. Further, another transfer material was prepared to have a multilayer metal film (pattern B) consisting of Ni and Mo films having thicknesses of 0.9 μm and 0.1 μm as lower and upper layers similarly to the multilayer metal film 23 shown in FIG. 9, in place of the ferromagnetic metal films 6A and 6B shown in FIG. 5 prepared in Example 1.

Figure 10:
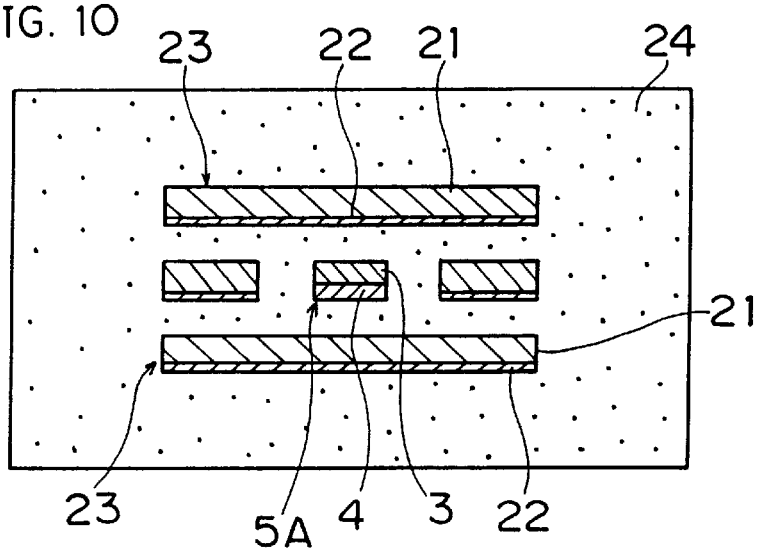
FIG. 10 is a sectional view showing a ceramic laminate obtained in Example 2.

Then, an alumina green sheet having a thickness of 200 μm was prepared, so that the multilayer metal film 23 shown in FIG. 9 was transferred to one major surface of this alumina green sheet. Thereafter another alumina green sheet having a thickness of 7 μm was transferred onto the multilayer metal film 23, with further transfer of the metal thin film 5*a* (pattern A) shown in FIG. 3 and the aforementioned pair of multilayer metal films (pattern B). In addition, still another alumina green sheet having a thickness of 7 μm was stacked thereon and another multilayer metal film 23 (pattern C) shown in FIG. 9 was further transferred onto this alumina green sheet. Thereafter a further alumina green sheet having a thickness of 200 μm was stacked on the multilayer metal film 23 and pressurized in the thickness direction, thereby obtaining a ceramic laminate 24 shown in FIG. 10.

Figure 11:
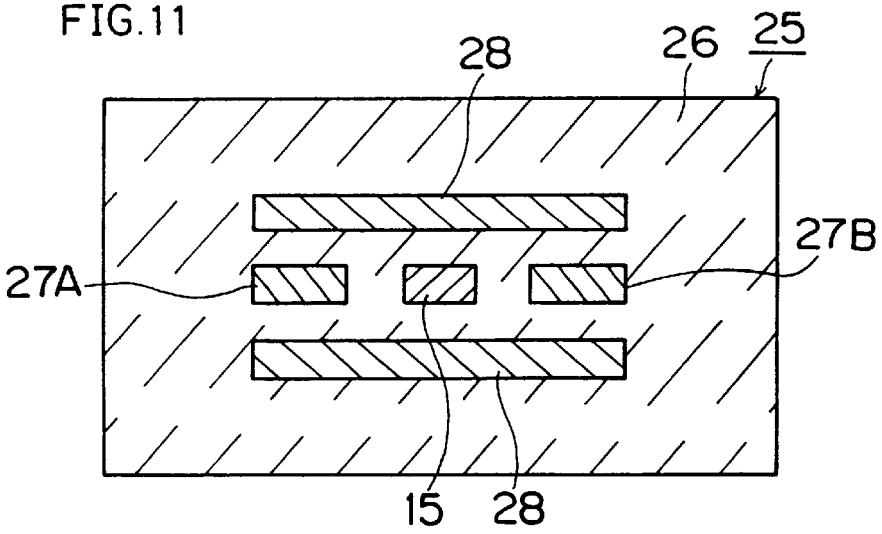
FIG. 11 is a sectional view showing a ceramic multilayer substrate according to Example 2.

Then, the ceramic laminate 24 was fired in a reducing atmosphere, to obtain a ceramic multilayer substrate 25 shown in FIG. 11. In this ceramic multilayer substrate 25, a conductor 15 defined by the metal thin film 5A which was sintered in the firing is arranged at an intermediate vertical position. Further, the multilayer metal films consisting of the Ni and Mo films were alloyed to define ferromagnetic metal films 27A and 27B mainly composed of Ni, which are arranged on both sides of the conductor 15. In addition, the multilayer metal films 23 were alloyed to define ferromagnetic metal films 28, which are arranged above and under the conductor 15.

EXAMPLE 3

Ni and Fe films having thicknesses of 0.8 μm and 0.2 μm were successively deposited on the overall major surface of a conductive substrate, in place of the glass substrate 1 prepared in Example 1. The Ni-Fe film was patterned by photolithography, to form a pattern C having a thickness of 1.0 mm similarly to the multilayer metal film 23 shown in FIG. 9. Similarly, ferromagnetic metal film transfer materials (pattern B) was prepared by replacing the materials forming the ferromagnetic metal films 6A and 6B of FIG. 5 by Fe films, similarly to the above. Further, a Pt film having a thickness of 1.0 $\mu$m was deposited on a major surface of a glass substrate 1, which was similar to that employed in Example 1, provided with a lubricant material layer 2, and patterned (pattern A) similarly to that in FIG. 3, to prepare a transfer material provided with a Pt film having a thickness of 500 $\mu$m.

Then, the transfer materials having the patterns A to C were employed to prepare a ceramic multilayer substrate similarly to Example 2.

Comparative Example

Ag and Pd films 3 and 4 were deposited on a major surface of a glass substrate 1, which was similar to that employed in Example 1, provided with a lubricant material layer 2, and patterned similarly to Example 1, to form a pattern A.

Then, the metal film of the pattern A was transferred to one major surface of an alumina green sheet having a thickness of 200 $\mu$m, and another alumina green sheet having a thickness of 200 $\mu$m was stacked thereon and pressurized along the thickness direction, to obtain a ceramic laminate.

Figure 12:
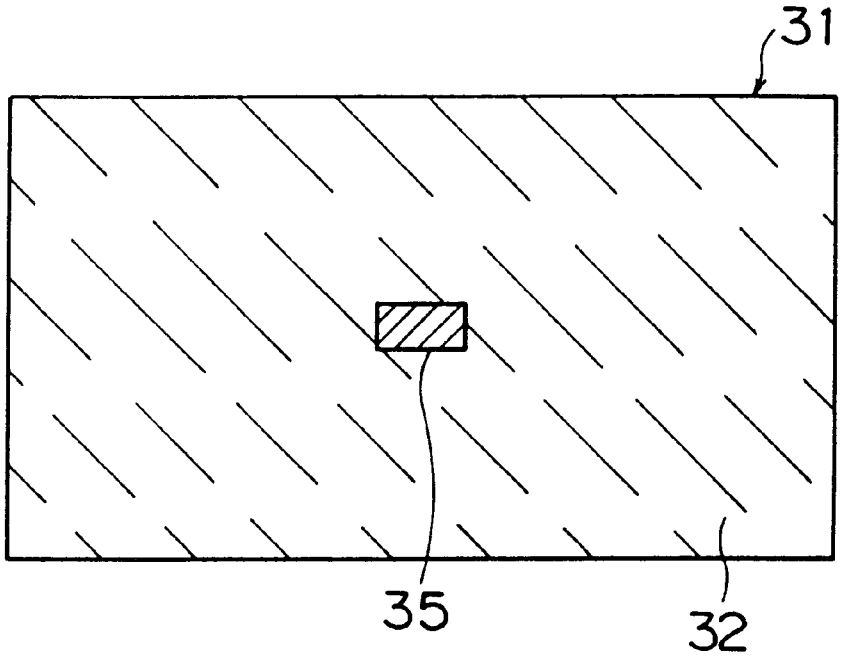
FIG. 12 is a sectional view showing a ceramic multilayer substrate according to comparative example.

The ceramic laminate obtained in the aforementioned manner was fired to form a ceramic substrate 31 shown in FIG. 12 as comparative example. In the ceramic substrate 31, a conductor 35 consisting of an Ag—Pd alloy is arranged in a ceramic sintered body 32.

Evaluation of Examples 1 to 3 and Comparative Example

Inductance values were measured as to the respective multilayer substrates of Examples 1 to 3 and comparative example obtained in the aforementioned manner. Table 1 shows the results.

TABLE 1

| | Example 1 | Example 2 | Example 3 | Comparative Example |
|---|---|---|---|---|
| Inductance (nH) | 120 | 800 | 1000 | 10 |

As clearly understood from Table 1, it is possible to attain a high inductance in each of Examples 1 to 3, since at least one ferromagnetic metal film is arranged on either side of the conductor. In particular, it is possible to further improve the inductance in Example 2 as compared with Example 1 since the ferromagnetic metal films are arranged not only on both sides but above and under the conductor, while a larger inductance can be attained in Example 3 since the Ni-Fe alloy is employed as the material forming the ferromagnetic metal films.

While it is possible to attain a high inductance in Example 3 as described above since the material forming the ferromagnetic metal films is prepared from Fe, a ceramic firing atmosphere must be prepared from a strong reducing atmosphere in order to obtain the multilayer substrate according to Example 3, since Fe is easy to oxidize.

Further, it is clearly understood from Table 1 that the length of the conductor must be remarkably increased in order to attain an inductance which is similar to that of each Example in the structure of comparative example merely arranging the conductor in the ceramic substrate. In addition, it is conceivable that a conventional inductor which is obtained by stacking a ferrite sheet and a conductor with each other and forming a ferrite portion around the conductor requires a substrate thickness of about 3 to 5 times as compared with the substrate employed in each Example, in order to obtain an inductance value which is equivalent to that of the inductance element of each Example shown in Table 1. Thus, it is understood possible to provide a miniature electronic component having a built-in inductor exhibiting a high inductance value according to the present invention.

Figure 13:
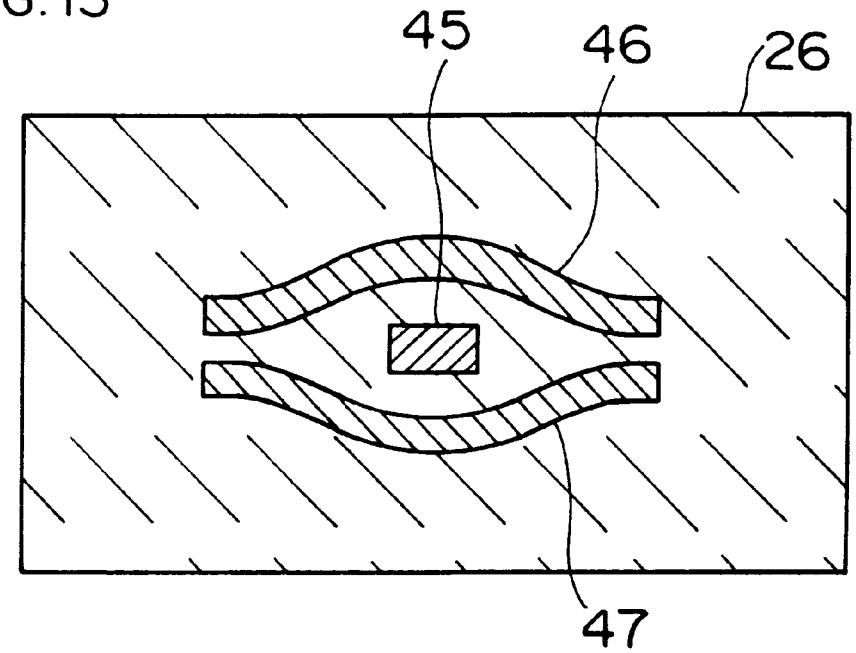
FIG. 13 is a sectional view showing a ceramic multilayer substrate according to a modification of the present invention.

As shown in FIG. 13, ferromagnetic metal films 46 and 47 which are arranged in proximity to a conductor 45 may have curved surfaces, to hold the conductor 45 therebetween.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electronic component having a built-in inductor, comprising:

a ceramic substrate consisting of a single insulating material;

a conductor being provided in said substrate; and at least one photolithographically-patterned ferromagnetic metal film made of a material other than a ferrite being provided in said substrate to be separated from but in proximity to said conductor.

2. The electronic component having a built-in inductor in accordance with claim 1, wherein said ferromagnetic metal film consists essentially of Ni and Mo.

3. The electronic component having a built-in inductor in accordance with claim 1, wherein said ferromagnetic film consists essentially of Ni and Fe.

4. An electronic component having a built-in inductor according to claim 1, wherein said ferromagnetic metal film has a thickness of approximately 1.0 $\mu$m.

5. The electronic component having a built-in inductor in accordance with claim 1, wherein said ferromagnetic metal film is made of or mainly composed of Ni.

6. The electronic component having a built-in inductor in accordance with claim 1, wherein said ceramic substrate is a ceramic multilayer substrate.

7. The electronic component having a built-in inductor in accordance with claim 1, wherein said ferromagnetic metal film is arranged in said substrate to be flush with said conductor.

8. The electronic component having a built-in inductor in accordance with claim 7, wherein at least another ferromagnetic metal film is arranged in said substrate in a position being opposed to said conductor through an insulating material layer forming said substrate.

9. The electronic component having a built-in inductor in accordance with claim 7, wherein said ferromagnetic metal film is made of or mainly composed of Ni.

10. The electronic component having a built-in inductor in accordance with claim 7, wherein said substrate is a multilayer substrate.

11. The electronic component having a built-in inductor in accordance with claim 8, wherein said ferromagnetic metal film is made of or mainly composed of Ni.

12. The electronic component having a built-in inductor in accordance with claim 8, wherein said substrate is a multilayer substrate.

13. The electronic component having a built-in inductor in accordance with claim 1, wherein said ferromagnetic metal film is arranged in said substrate in a position being opposed to said conductor surface through an insulating material layer forming said substrate.

14. The electronic component having a built-in inductor in accordance with claim 13, wherein said ferromagnetic metal film is made of or mainly composed of Ni.

15. The electronic component having a built-in inductor in accordance with claim 13, wherein said substrate is a multilayer substrate.

16. An electronic component having a built-in inductor comprising:

a ceramic substrate consisting of a single insulating material;

a conductor in said substrate, said conductor having a top surface, a bottom surface and first and second opposing side surfaces;

first and second ferromagnetic metal films made of a material other than a ferrite provided in said substrate above a top surface of said conductor and below the bottom surface of said conductor, respectively, in spaced relationship but in proximity to said conductor; and third and fourth ferromagnetic metal films made of a material other than a ferrite provided in said substrate in opposing relationship to said opposing first and second sides, respectively, in spaced relationship but in close proximity to said conductor.

17. The electronic component having a built-in inductor in accordance with claim 16, wherein said ferromagnetic metal films comprise Ni.

18. The electronic component having a built-in inductor in accordance with claim 16, wherein said ferromagnetic metal films comprise Ni and Mo.

19. The electronic component having a built-in inductor in accordance with claim 16, wherein said ferromagnetic films comprise Ni and Fe.

20. The electronic component having a built-in inductor in accordance with claim 16, wherein said ceramic substrate is a ceramic multilayer substrate.

* * * * *